United States Patent [19]

Niederer et al.

[11] 4,360,099

[45] Nov. 23, 1982

[54] EGG TRANSFER APPARATUS

[75] Inventors: Lee H. Niederer; Thomas O. Niederer, both of Titusville, N.J.

[73] Assignee: Otto Niederer Sons, Inc., Pennington, N.J.

[21] Appl. No.: 200,120

[22] Filed: Oct. 24, 1980

[51] Int. Cl.[3] ..... B65G 47/00

[52] U.S. Cl. ..... 198/424; 198/486; 53/248

[58] Field of Search ..... 198/424, 486, 653, 655, 198/656; 53/248, 247, 539, 255, 260, 261, 262

[56] References Cited

U.S. PATENT DOCUMENTS

| | | | |
|---|---|---|---|
| 1,394,445 | 10/1921 | Rogers . | |
| 1,718,607 | 6/1929 | Soubies | 198/486 X |
| 2,141,112 | 12/1938 | Neupert . | |
| 2,497,655 | 2/1950 | Bramson . | |
| 2,619,216 | 11/1952 | Kinnicutt, Jr. . | |
| 2,687,802 | 8/1954 | Davis . | |
| 2,711,813 | 6/1955 | Jordan . | |
| 2,717,729 | 9/1955 | Page et al. . | |
| 2,895,589 | 7/1959 | Rostron . | |
| 2,919,787 | 1/1960 | Reck et al. . | |
| 3,311,216 | 3/1967 | Jones . | |
| 3,370,692 | 2/1968 | Mosterd . | |
| 3,463,292 | 8/1969 | Booij et al. . | |
| 3,592,327 | 7/1971 | Koch et al. . | |
| 3,610,400 | 10/1971 | Burkholder . | |
| 3,973,667 | 8/1976 | Jellema et al. | 198/424 |

*Primary Examiner*—John J. Love

*Assistant Examiner*—Paul A. Sobel

*Attorney, Agent, or Firm*—John J. Kane; Frederick A. Zoda; Albert Sperry

[57] ABSTRACT

An egg transfer apparatus as disclosed which is adapted to receive eggs from a position thereabove and transport the eggs gently to a location therebelow which includes a carriage plate which is generally vertically movable with respect to a housing. A slide retaining device fixedly secured to the carriage plate defines a slide channel which is adapted to receive therein a slide member which is approximately horizontally movable with respect to the vertically movable carriage plate. A cam arm is rotatably mounted in the housing and a cam roller is secured thereto. A cam follower is fixedly secured with respect to the slide member in a position adjacent the cam roller. Rotation of the cam arm causes engagement of the cam roller and cam follower causing movement of the slide member within the slide channel. With this configuration the vertical movement of the carriage with respect to the housing will cause cyclical horizontal movement of the slide member. An egg holding device generally divided into two egg support members is adapted to receive an egg therein. One of the egg support members is fixedly secured with respect to the carriage and the other egg support member is fixedly secured with respect to the slide member such that vertical movement of the carriage plate and rotation of the cam arm will cause opening and closing movement of the egg support members to selectively retain or release an egg from the egg holding device.

8 Claims, 4 Drawing Figures

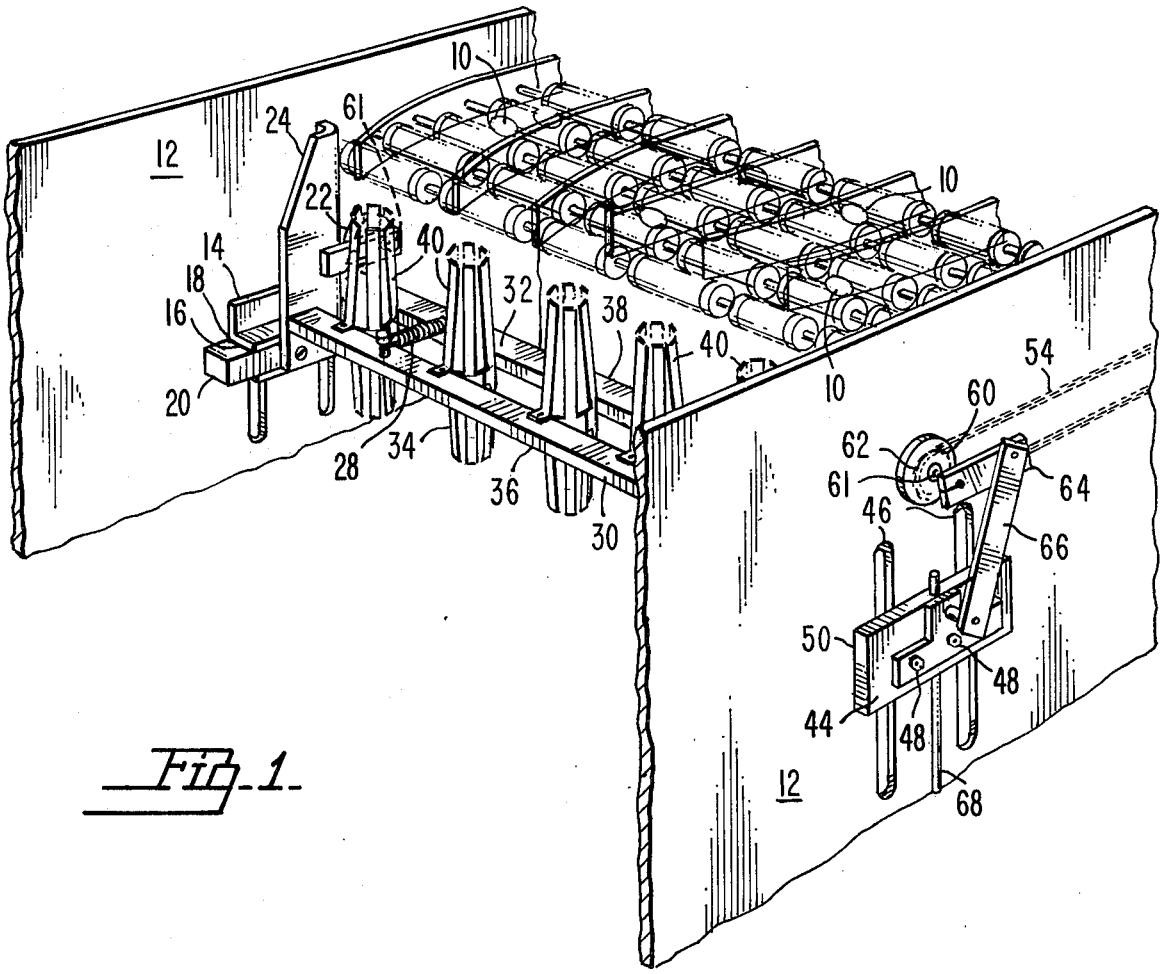
Fig. 1
Fig. 4
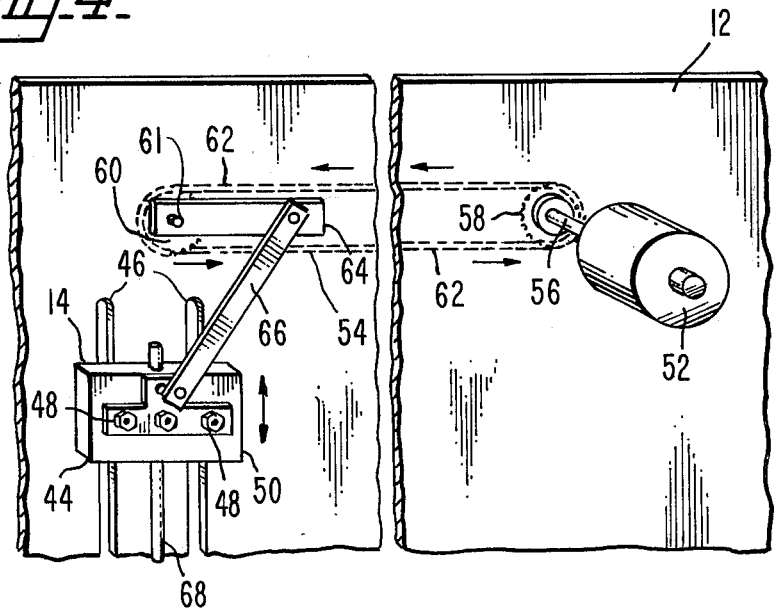

EGG TRANSFER APPARATUS

BACKGROUND OF THE INVENTION

1. Field of the Invention

The present invention pertains to the field of egg transfer devices usable in the movement of eggs throughout an egg processing system which normally includes candlers, orientation means, graders, packers, washing devices, etc. The present invention provides a means for the movement of eggs from a location where the eggs are released from a conveyor or other means thereabove to a location below the device with a minimum of egg breakage.

2. Description of the Prior Art

Configurations generally illustrating movement devices for eggs are shown on U.S. Pat. Nos. 2,497,655; 2,704,146; 2,711,813; 2,895,589; 2,919,787, 3,075,629; 3,126,993; 3,311,216; 3,370,692; 3,463,292; 3,592,327; 3,610,400; 1,394,445; 2,141,112; 2,687,802; 2,619,216 and 2,717,729. None of these patents or any other prior art known to the applicant discloses the concept of the two-part egg holding means which is caused to open and close responsive to a camming means secured to a vertically movable carriage plate. Most prior art devices utilize vacuum or other means which individually grip the eggs from their location and place them directly therebelow rather than allowing the eggs to fall into a resilient spring retaining means as shown in the present invention and cyclically release to a position therebelow.

SUMMARY OF THE INVENTION

The present invention provides an egg transfer apparatus usable particularly for the receiving of eggs from thereabove and the transporting vertically to a location therebelow. The transfer apparatus includes a housing means which is defined as the basic structural housing normally positioned about egg transfer equipment such as conveyors and the like. A carriage plate will be movably secured with respect to this housing means. The carriage plate will include a slide retaining means which is fixedly secured with respect thereto which provides a slide channel therein which extends in a generally horizontally extending position. This slide channel is adapted to receive a horizontally movable slide member therein such that the slide member is thereby horizontally slideable with respect to the carriage plate itself.

Preferably a cam follower is fixedly secured with respect to the slide member such that horizontal movement of the slide member will result from similar horizontal movement of the cam follower. A cam arm is rotatably movable with respect to the housing and a cam roller is fixedly secured thereto. The cam arm is positioned adjacent to the normal position of the cam follower such that the cam follower may rest against the shaft about which the cam arm rotates. Upon rotation of the cam arm the cam roller will be caused to contact the cam follower causing it to move outwardly with resulting horizontal movement of the slide member within the slide channel. As the cam arm rotates further through its cyclic motion the cam roller will be disengaged from the cam follower with the slide member as well as the cam follower moving in the opposite horizontal direction such as to be again contacting the shaft of rotation of the cam arm. The cam follower is biased into position abutting the rotation shaft of the cam arm by a biasing means such as a retaining spring.

A first bracket means is included and is fixedly secured with respect to the slide member such as to be movable therewith. Similarly, a second bracket means is fixedly secured with respect to the carriage plate to be movable therewith. These two bracket means are biased together by a biasing means such as the retaining spring described above. The egg holding means which is adapted to receive an egg from a location thereabove and gently deposit the egg at a location therebelow includes a first egg support member which is preferably secured with respect to the first bracket means. The egg holding means also includes a mated cooperating second egg support member which is fixedly secured with respect to the second bracket means. In this manner the egg holding means will include two such support members which are adapted to selectively separate and move together for egg release and retaining, respectively, responsive to the horizontal component of movement of the slide member within a slide channel caused by engagement of the cam follower member with respect to the cam edge.

Preferably the individual support members are configured as a plurality of flat spring steel members which are fixedly secured with respect to one another and generally extend in a vertical direction with inwardly facing arcuate surfaces. In this manner a very soft gentle, but firm means will be provided for the receiving and holding of the eggs therein.

Vertical movement of the carriage plate with respect to the housing means is preferably provided by a guide means which includes a plurality of guide slots defined in the housing means which extends generally vertically in the portion thereof immediately adjacent to the carriage member. A plurality of guide members fixedly secured with respect to the carriage plate will generally extend through these guide slots to maintain orientation of the carriage plate with respect to the housing. A backing plate is fixedly secured with respect to the guide members to maintain the lateral positioning of the guide members extending accurately through the guide slots during vertical movement of the carriage plate. A guide stud being fixedly secured with respect to the housing may extend upwardly through the backing plate such that it is vertically movable therealong with vertical alignment maintained. A drive means is preferably operably secured with respect to the backing plate to cause vertical movement thereof and vertical movement of the carriage plate.

Operable connection between the drive means and the backing plate is preferably provided by a linkage means which includes a drive output shaft connected to the drive means to be driven rotatably thereby. A first sprocket means is adapted to be fixedly secured upon this drive output shaft. A chain means is adapted to extend around this first sprocket means to be movable therewith and a second sprocket means is preferably rotatably secured with respect to the housing means at a location above the slot means such that the chain means extends around this second sprocket means also for selectively causing rotation thereof responsive to actuation of said driving means. A clamp means is adapted to be adjustably secured to the secons sprocket means and extend radially outward from the axis of rotation thereof. Lastly, a link means is preferably pivotally secured to the outermost end of the clamp means and also is pivotally secured to the backing plate to cause vertical movement of the backing plate and the carriage plate responsive to rotation of the second sprocket means. In this manner actuation of the drive means will cause vertical movement of the carriage means with the resultant opening and closing of the egg holding means. The shaft about which the second sprocket means rotates may extend through the housing and provide the rotational shaft to which the cam arm is secured. In this manner the timing will be coordinated between vertical movement of the carriage plate and horizontal movement of the horizontally movable egg support members with respect to horizontally stationary egg support members.

It is an object of the present invention to provide an egg transfer apparatus for the receiving of eggs from a location thereabove and the transporting of eggs vertically to a location therebelow with a minimum of egg breakage.

It is an object of the present invention to provide an egg transfer apparatus for moving eggs from a location thereabove to a location therebelow which is performed in a speedy fashion without causing wastage.

It is an object of the present invention to provided an egg transfer apparatus which is adapted for usage with a conventional housing of a standard egg conveyor apparatus.

It is an object of the present invention to provide an egg transfer apparatus which causes vertical movement of eggs retained therein with the grasping at the upper end of the vertical movement and release at the lower end of the vertical movement achieved by a camming movement synchronized with the cyclical vertical movement.

It is an object of the present invention to provide an egg transfer apparatus for the receiving of eggs from the location thereabove and transfering it to an egg receiving the means located therebelow wherein the volume is greater than achievable heretofore.

It is an object of the present invention to provide an egg transfer apparatus including a carriage which is vertically movable with respect to the housing of the egg processing equipment and a slideable member which is horizontally movable with respect to said carriage in order to effectively open and close the egg retaining means.

It is an object of the present invention to provide an egg transfer apparatus particularly adapted to successful high speed handling of a wide variety of egg sizes without requiring adjustment of the apparatus.

It is an object of the present invention to provide an egg transfer apparatus which includes an egg holding means defined by a plurality of soft, flat spring members which is adapted to receive an egg gently therein and move the egg vertically for easy placement upon a conveyor or the like located therebelow.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective illustration of an embodiment of the egg transfer apparatus of the present invention;

FIG. 4 is a side plan view of an embodiment of the egg transfer apparatus of the present invention viewing from the outside showing the backing plate and the guide means and linkage means for maintaining vertical alignment of the carriage means with respect to the housing.

DETAILED DESCRIPTION OF THE PREFERRED EMBODIMENT

Figure 2:
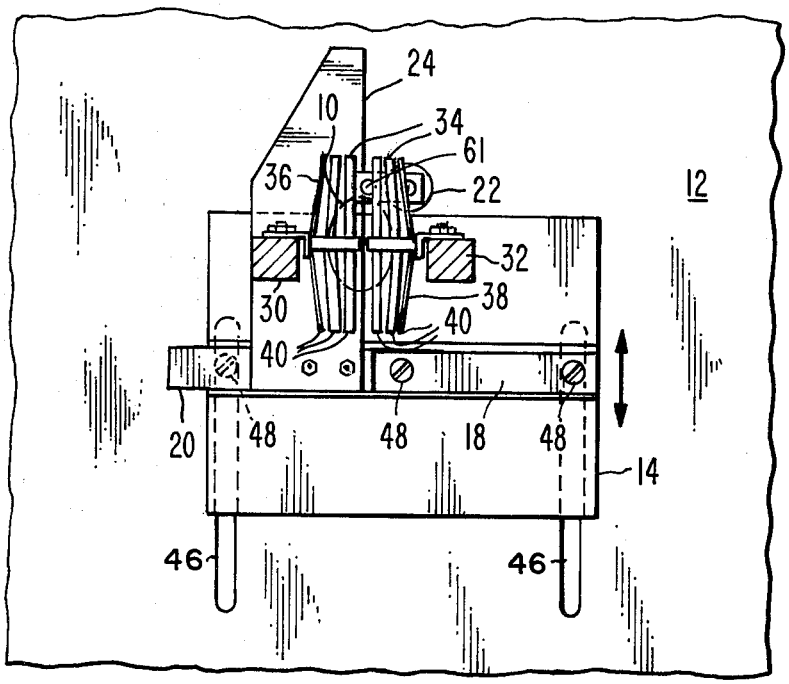
FIG. 2 is a side plan view of an embodiment of the egg transfer apparatus of the present invention showing the carriage plate and slide member in the egg retaining position.
Figure 3:
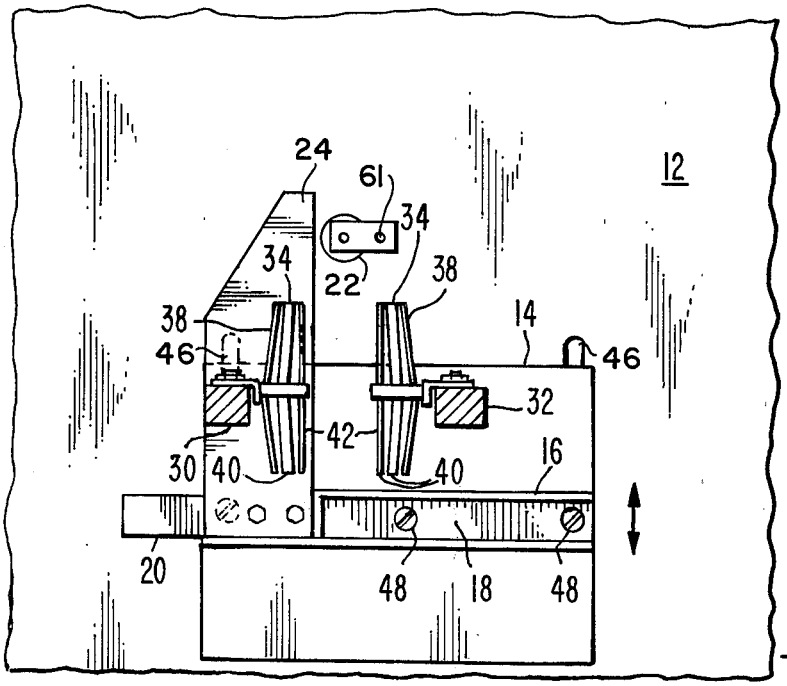
FIG. 3 is a side plan view of an embodiment of the egg transfer apparatus of the present invention showing the carriage plate and slide member in the egg releasing position.

The present invention provides an egg transfer apparatus adapted for the receiving of eggs 10 from a position thereabove and transporting of the eggs vertically to a location therebelow which minimizes egg breakage and is capable of achieving high speed and high volume operation. This transfer apparatus is adapted to be positioned adjacent to a convenient housing 12.

Carriage plate 14 is adapted to be positioned adjacent to the housing means 12 in such a fashion as to be vertically movable with respect thereto. Each carriage plate will include a slide retaining means 16 which is fixedly secured thereto and which defines a slide channel 18 therein extending generally horizontally in a direction parallel to the housing means 12. A slide member 20 is secured with respect to the carriage plate within the slide channel 18 in a movable fashion such as to be horizontally movable with respect thereto.

A cam arm 26 is preferably rotatably mounted with respect to the housing 12 and includes a cam roller 22 secured at the outer end thereof. A cam follower 24 extends vertically adjacent to the position of the cam arm 26 and to cam roller 22. This cam follower 24 is fixedly secured with respect to the slide member 20 horizontally slideably mounted within the slide channel 18. A retaining spring 28 extends between members fixedly secured with respect to the cam follower 24 and the cam arm 26 and in this manner biases these members together. However, then the cam arm 26 rotates to a position such that the cam roller 22 engages the cam follower 24 the strength of the retaining spring or biasing member 28 will be overcome to an extent such that cam follower 24 and the slide member 20 will be urged in a direction horizontally away from the stationary position. Similarly, when the cam arm 26 rotates it to a position such that the cam roller member 22 is out of engagement with the cam follower 24 that edge will be biased by the retaining spring 28 into contact with the shaft about which the cam arm 26 does rotate.

A first bracket means 30 is adapted to be fixedly secured with respect to the slide member 20. A second bracket means 32 is adapted to be fixedly secured with respect to the carriage plate 14.

An egg holding means 34 will be secured with respect to the other apparatus of the present egg transfer means and will include a first egg support member 36 and a second egg support member 38. First egg support member 36 will be fixedly secured with respect to the first bracket means 30. Second egg support member 38 will be fixedly secured with respect to second bracket means 32. With this configuration vertical movement of the carriage plate and coordinated horizontal movement of the slide member will result in movement of the first and second egg support members 36 and 38 toward and away from one another in a cyclical operation such as to selectively cause grasping or release of an egg by the egg holding means 34.

To minimize egg breakage, each of the support members 36 and 38 preferably includes a plurality of vertically extending flat spring steel members 40. These members 40 also preferably include inwardly facing arcuate surfaces 42 to gently grasp an egg and minimize the percentage of breakage thereof.

In order to maintain correct vertical alignment between the carriage plate 14 and the housing 12 a guide means 44 is included. This configuration includes a plurality of vertically extending guide slots 46 defined in the housing means 12. A plurality of guide members 48 extend through these guide slots 46. The guide members 48 are fixedly secured with respect to the carriage plate 14 such that the carriage plate moves along the vertical direction defined by the guide slots 46. A backing plate 50 is fixedly secured to the guide members 48 on the side of the housing means 12 opposite from the location of the carriage plate 14. In this manner correct accuracy of alignment of the guide members 48 within the guide slots 46 will be maintained and also a means for driving the carriage plate in a vertical direction will be achieved. A drive means 52 is preferably operably secured with respect to the backing plate 50 to selectively cause vertical movement thereof.

Operational control between the drive means 52 and the backing plate 50 is achieved by a linkage means 54 secured therebetween. This linkage means 54 includes a drive output shaft secured fixedly to the output of drive means 52. A first sprocket means 58 is fixedly secured to shaft 56. A second sprocket means 60 is preferably rotatably secured to the outer facing surface of the housing means 12. A chain means 62 is fixedly secured around the first and second sprocket means 58 and 60 respectively in such a fashion to cause cooperating movement thereof. A clamp means 64 is fixedly secured to the second sprocket means and extends outwardly radially from the axis of rotation thereof. A link means 66 is pivotally secured to the outer end of the clamp means 64 as well as being pivotally secured to the backing plate 50. In this manner rotational movement of the second sprocket means will cause vertical movement of the backing plate 50 and also of carriage plate 14.

In order to further maintain the vertical alignment of the carriage plate 14 and the backing plate 50 a guide stud 68 being in fixed securement with respect to the housing means 12 may extend vertically through the backing plate in such a fashion that the backing plate is slideably movable vertically therealong. In this manner vertical alignment is maintained.

A shaft means 61 which may provide the rotational axis for the second sprocket means will preferably extend through the housing and also provide the rotational axis for the cam arm 26. In this manner coordinated movement between rotation of the cam arm 26 and vertical movement of the carriage plate 14 will be achieved. This interlocking is through clamp means 64 and link means 66. In this manner the correct timing will be achieveable of the opening or closing of the first and second bracket means 30 and 32 with respect to one another responsive to the vertical position resulting from vertical movement of the carriage plate 14.

In the preferred configuration of the present invention a carriage plate and backing plate type configuration will be duplicated on opposite sides of a conveying system including a single bracket extending therebetween transversely across the egg movement direction. Normally eggs are received in a six wide array and as a result normally a single set of first and second bracket means will be fixedly secured to six egg holding means and six cooperating set of first and second egg support members. This configuration is best shown in FIG. 1.

In operation, a drive means 52 will be continuously operating to drive an output shaft 56. A first sprocket means 58 will thereby be continuously rotated as well as the chain means 62. Rotation of the second sprocket means 60 and of the clamp means 64 will cause vertical movement of the backing plate 50 through link means 66. It is at this point that the rotational movement of the drive means is converted into vertical movement of the backing plate 50 in a normal conventional manner. Vertical movement of backing plate 50 will cause vertical movement of the carriage plate 14 as a result of the guide means 44. The slots 46 and the members 48 extending therethrough maintain accurate alignment between the backing plate 50 and the carriage plate 14.

Vertical movement of the carriage plate 14 will be coordinated with engagement of cam follower 22 with respect to cam edge 24. The first and second bracket means will remain in the closed position except when the carriage plate 14 is at the bottom of the stroke. At this time the cam roller 22 will engage the cam follower 24 resulting in opening of the egg holding means 34. This movement will result through the cooperating securement of the first and second bracket means in opening and closing of the egg holding means by separating and closing of the first and second egg support member. At the top of the stroke of the carriage plate 14 the first and second egg support members will be at their closest point and thereby be in the retaining position. As the carriage plate moves downwardly the cam roller will engage the cam follower and the first and second egg support members will separate and release an egg therebelow. As the carriage plate moves again upwardly the first and second egg support member will start to travel toward one another and will "catch" an egg which has gently started to fall from a location thereabove. In this manner eggs will be continuously moved from an upper location to a lower location in a fast and simple fashion with a minimum of breakage thereof.

While particular embodiments of this invention have been shown in the drawings and described above, it will be apparent that many changes may be made in the form, arrangement, and positioning of the various elements of the combination. In consideration thereof it should be understood that preferred embodiments of this invention disclosed herein are intended to be illustrative only and not intended to limit the scope of the invention.

I claim:

1. An egg transfer apparatus, for the receiving of eggs from thereabove and the transporting vertically to a location therebelow, which comprises:

(a) a housing means;

(b) a carriage plate movably secured with respect to said housing means;

(c) a slide retaining means fixedly secured with respect to said carriage plate and defining a slide channel therein extending approximately horizontally and adapted to receive a horizontally movable member therein;

(d) a slide member movably secured within said slide channel of said slide retaining means to allow horizontal movement thereof;

(e) a cam follower fixedly secured with respect to said slide member;

(f) a cam arm mounted with respect to said housing means for rotational movement with respect thereto, said cam arm being mounted adjacent said cam follower;

(g) a cam roller mounted on said cam arm and being selectively engageable with respect to said cam follower responsive to rotational movement of said cam arm with respect to said housing to urge said slide member to move within said slide retaining means;

(h) a first bracket means fixedly secured with respect to said slide member and said cam follower to be movable therewith;

(i) a second bracket means fixedly secured with respect to said carriage plate to be movable therewith; and (j) an egg holding means adapted to receive an egg from thereabove and gently deposit the egg at a location therebelow, said egg holding means comprising a first egg support member fixedly secured with respect to said first bracket means and a second egg support member fixedly secured with respect to said second bracket means to selectively open and close said egg holding means responsive to horizontal movement of said slide member within said slide channel;

(k) a biasing means secured with said first bracket means and said second bracket means to bias them toward one another.

2. The apparatus as defined in claim 1 wherein said egg holding means comprises a plurality of flat spring members fixedly secured adjacent to one another and presenting inwardly facing arcuate surfaces to facilitate holding of an egg therein.

3. The apparatus as defined in claim 1 wherein said second egg support means is stationary with respect to said carriage plate and said first egg support means is movable with respect thereto to cause opening and closing of said egg holding means responsive to movement of said first and second egg support means away from and toward one another, respectively.

4. The apparatus as defined in claim 1 further including a guide means to facilitate approximately vertical movement of said carriage plate with respect to said housing means, said guide means including:

(a) a plurality of guide slots extending approximately vertically and defined by said housing means in the portion thereof immediately adjacent said carriage member;

(b) a plurality of guide members fixedly secured with respect to said carriage plate and extending through said guide slots; and (c) a backing plate fixedly secured to said guide members adjacent to said housing means on the opposite side from said carriage plate.

5. The apparatus as defined in claim 4 further comprising a vertically extending guide stub being fixedly secured with respect to said housing and extending vertically through said backing plate, said backing plate being vertically movable therealong.

6. The apparatus as defined in claim 4 further including a drive means operably secured with respect to said backing plate to cause vertical movement thereof and resulting vertical movement of said carriage plate.

7. The apparatus as defined in claim 6 further including a linkage means operably connecting said drive means to said backing plate to cause selective vertical movement thereof, said linkage means comprising:

(a) a drive output shaft connected to said drive means to be driven rotatably thereby;

(b) a first sprocket means fixedly secured with respect to said drive output shaft;

(c) a chain means positioned about said first sprocket means to be movable therewith;

(d) a second sprocket means rotatably secured with respect to said housing means at a location above said slot means, said chain means extending around said second sprocket means for driving same upon actuation of said driving means;

(e) a clamp means adjustably secured with respect to said second sprocket means and extending radially outward from the axis of rotation thereof; and (f) a link means pivotally secured to the outermost end of said clamp means, said link means being also pivotally secured to said backing plate to cause vertical movement of said backing plate and said carriage plate responsive to rotation of said second sprocket means.

8. An egg transfer apparatus, for the receiving of eggs from thereabove and the transporting vertically to a location therebelow, which comprises:

(a) a housing means;

(b) a carriage plate movably secured with respect to said housing means;

(c) a guide means to facilitate vertical movement of said carriage plate with respect to said housing means, said guide means including:

1. a plurality of guide slots extending approximately vertically and defined by said housing means in the portion thereof immediately adjacent said carriage member;
2. a plurality of guide members fixedly secured with respect to said carriage plate and extending through said guide slots;
3. a backing plate fixedly secured to said guide members adjacent to said housing means on the opposite side from said carriage plate;

(d) a drive means operably secured with respect to said backing plate to cause vertical movement thereof and resulting vertical movement of said carriage plate;

(e) a linkage means operably connecting said drive means to said backing plate to cause selective vertical movement thereof, said linkage means comprising:

1. a drive output shaft connected to said drive means to be driven rotatably thereby;
2. a first sprocket means fixedly secured with respect to said drive output shaft;
3. a chain means positioned about said first sprocket means to be movable therewith;
4. a second sprocket means rotatably secured with respect to said housing means at a location above said slot means, said chain means extending around said second sprocket means for driving same upon actuation of said driving means;
5. a clamp means adjustably secured with respect to said second sprocket means and extending radially outward from the axis of rotation thereof; and 6. a link means pivotally secured to the outermost end of said clamp means, said link means being so pivotally secured to said backing plate to cause vertical movement of said backing plate and said carriage plate responsive to rotation of said second sprocket means;

(f) a slide retaining means fixedly secured with respect to said carriage plate and defining a slide channel therein extending approximately horizontally and adapted to receive a horizontally movable member therein;

(g) a slide member movably secured within said slide channel of said slide retaining means to allow horizontal movement thereof;

(h) a cam follower fixedly secured with respect to said slide member;

(i) a cam arm mounted with respect to said housing means for rotational movement with respect thereto, said cam arm being mounted adjacent said cam follower;

(j) a cam roller mounted on said cam arm and being selectively engageable with respect to said cam follower responsive to rotational movement of said cam arm with respect to said housing to urge said slide member to move within said slide retaining means;

(k) a first bracket means fixedly secured with respect to said slide member to be movable therewith;

(l) a second bracket means fixedly secured with respect to said carriage member to be movable therewith;

(m) an egg holding means adapted to receive an egg from thereabove and gently deposit the egg at a location therebelow, said egg holding means comprising a first egg support member fixedly secured with respect to said first bracket means and a second egg support member fixedly secured with respect to said second bracket means to selectively separate and move together for egg release and retaining, respectively, responsive to horizontal movement of said slide member within said slide channel, each of said first egg support member and said second egg support member comprising a plurality of vertically extending flat spring steel members fixedly secured adjacent to one another and presenting inwardly facing arcuate surfaces to facilitate holding of an egg therein; and (n) a biasing means secured with respect to said first bracket means and said second bracket means to bias them toward one another.

* * * * *